US011819142B2

(12) United States Patent
Crystal et al.

(10) Patent No.: US 11,819,142 B2
(45) Date of Patent: Nov. 21, 2023

(54) GARMENT FOR ASSISTING HOLDING AN INFANT

(71) Applicant: Gold Health LLC, Palo Alto, CA (US)

(72) Inventors: Ruth Ann Crystal, Palo Alto, CA (US); Jules P. Sherman, Palo Alto, CA (US)

(73) Assignee: Gold Health LLC, Palo Alto, CA (US)

( * ) Notice: Subject to any disclaimer, the term of this patent is extended or adjusted under 35 U.S.C. 154(b) by 0 days.

(21) Appl. No.: 17/454,133

(22) Filed: Nov. 9, 2021

(65) Prior Publication Data

US 2022/0248778 A1 Aug. 11, 2022

Related U.S. Application Data

(60) Provisional application No. 63/146,122, filed on Feb. 5, 2021.

(51) Int. Cl.
*A47D 13/02* (2006.01)
*A41D 1/215* (2018.01)

(52) U.S. Cl.
CPC ..... *A47D 13/02* (2013.01); *A41D 1/215* (2018.01); *A41D 2400/482* (2013.01)

(58) Field of Classification Search
CPC ..... A41D 1/215; A41D 13/1245; A41D 13/1272; A41D 13/1281; A41D 2300/30;
(Continued)

(56) References Cited

U.S. PATENT DOCUMENTS 3,843,971 A * 10/1974 Delanty ..... A41D 13/1209 2/96
4,031,566 A * 6/1977 Johnson ..... A41D 1/215 2/104

(Continued)

FOREIGN PATENT DOCUMENTS

WO WO-2009081400 A2 * 7/2009 ..... A41D 1/205
WO WO-2017083950 A1 * 5/2017

(Continued)

OTHER PUBLICATIONS

Written Opinion of The International Searching Authority, PCT/US2021/021446, dated Jul. 28, 2021.

*Primary Examiner* — Heather Mangine
(74) *Attorney, Agent, or Firm* — Levine Bagade Han LLP

(57) ABSTRACT

A garment for assisting a user holding an infant is provided. The garment may include a first portion, a second portion, a first sleeve, and a second sleeve. The second portion may be configured to overlap the first portion when the garment is worn by the user. The first sleeve and the second sleeve may each extend from the first portion and the second portion, respectively. The first portion may define an elongated opening. The elongated opening may be positioned to provide access through the opening and to the infant from the outside of the garment while the first portion remains covered by the second portion. The garment may also include at least one fastener attached thereto. The at least one fastener may be positioned relative to the opening and may comprise at least one loop to secure at least part of a tubing or wire extending from the infant. The garment may also comprise a locking mechanism that can adjust the loop to the size of the tubing.

25 Claims, 16 Drawing Sheets

(58) Field of Classification Search
CPC ..... A41D 2300/32; A41D 2300/324; A41D 2400/482
See application file for complete search history.

(56) References Cited

U.S. PATENT DOCUMENTS 4,087,864 A * 5/1978 LaBove ..... A61B 5/6805 604/174
4,144,593 A * 3/1979 Timmons ..... A41D 1/215 2/104
4,168,544 A * 9/1979 Kallman ..... A45F 5/02 224/901.4
4,566,136 A * 1/1986 Echols ..... A41D 1/215 2/104
4,637,075 A * 1/1987 Ingrisano ..... A61F 17/00 2/253
4,718,124 A * 1/1988 Sawicki ..... A41D 13/129 2/114
4,723,323 A * 2/1988 Wright, Jr. ..... G09B 19/0076 2/244
5,440,763 A * 8/1995 Shah ..... A41D 13/1236 2/912
5,611,085 A * 3/1997 Rasmussen ..... A41D 13/1281 2/102
5,611,086 A * 3/1997 Eggen ..... A41D 1/215 2/104
5,652,961 A * 8/1997 Knight-Yurt ..... A41D 13/12 2/114
5,832,536 A * 11/1998 Kramer ..... A41B 9/06 2/69
5,836,310 A * 11/1998 Winters ..... A61F 5/3784 128/845
5,878,437 A * 3/1999 Pater ..... A41D 13/1236 2/912
5,893,171 A * 4/1999 Ries ..... A41D 1/215 2/48
5,897,519 A * 4/1999 Shesol ..... A61M 25/02 604/179
5,991,925 A * 11/1999 Wu ..... A41D 13/0012 224/931
6,032,289 A * 3/2000 Villapiano ..... A41D 13/1245 2/102
7,181,773 B1 * 2/2007 Piraka ..... A41D 13/1281 2/114
7,640,598 B1 * 1/2010 Mallik ..... A41D 1/215 2/48
11,019,860 B1 * 6/2021 Pierce ..... A41D 13/1236
11,202,477 B1 * 12/2021 Dawson ..... A41D 31/02
2004/0164107 A1 * 8/2004 Anderson ..... A61J 9/0676 224/160
2004/0244097 A1 * 12/2004 Kassai ..... A47D 13/025 2/310
2005/0054941 A1 * 3/2005 Ting ..... A61B 5/296 600/534
2006/0085890 A1 * 4/2006 Beuk ..... A41D 13/1281 2/114
2006/0206978 A1 * 9/2006 Hilton ..... A41D 1/215 2/104
2006/0218692 A1 * 10/2006 Lamarque ..... A61H 23/0263 2/114
2007/0157362 A1 * 7/2007 Rogers ..... A41D 13/1263 2/114
2007/0214549 A1 * 9/2007 Carr ..... A45F 3/02 2/312
2007/0240248 A1 * 10/2007 Hodges ..... A41D 1/215 2/104
2007/0271672 A1 * 11/2007 Lentini ..... A41D 13/1245 2/69
2007/0271675 A1 * 11/2007 Eraca ..... A41D 1/215 2/104
2008/0184455 A1 * 8/2008 Blume ..... A41D 13/1281 2/114
2009/0031471 A1 * 2/2009 Dague ..... A41D 13/1245 2/243.1
2009/0144876 A1 * 6/2009 Pena ..... A41D 13/0007 5/81.1 R
2010/0050315 A1 * 3/2010 Christou-Kelly .... A41D 13/129 2/114
2010/0064411 A1 * 3/2010 Price ..... A41D 13/1245 2/243.1
2010/0095424 A1 * 4/2010 Grgich ..... A41D 1/215 2/104
2010/0138996 A1 * 6/2010 Davis ..... A47D 5/006 2/104
2010/0242150 A1 * 9/2010 Trouillot ..... A41D 13/1245 2/114
2011/0023208 A1 * 2/2011 Liao ..... A61M 25/02 2/102
2011/0041231 A1 * 2/2011 Behrens ..... A41D 13/1245 2/250
2011/0307994 A1 * 12/2011 Woloschuk ..... A41D 27/08 2/102
2012/0078190 A1 * 3/2012 Austin ..... A61M 25/02 2/300
2012/0117710 A1 * 5/2012 Lenzen ..... A41D 13/1245 2/114
2012/0137400 A1 * 6/2012 Farris ..... A41D 13/1245 2/114
2012/0151651 A1 * 6/2012 Lenzen ..... A41D 13/1245 2/69
2012/0278973 A1 * 11/2012 Berkowitz ..... A41B 1/10 2/336
2013/0131617 A1 * 5/2013 Kovensky ..... A61F 5/4408 604/327
2013/0168422 A1 * 7/2013 Carbonell ..... A41D 1/215 224/158
2013/0291279 A1 * 11/2013 Jensen ..... A41D 1/215 2/69
2014/0068835 A1 * 3/2014 Toenjes ..... A41D 13/1245 2/114
2015/0150312 A1 * 6/2015 LaHann ..... A41F 1/002 24/465
2017/0006937 A1 * 1/2017 Wu ..... A41D 13/1245
2017/0027242 A1 * 2/2017 Asodaria ..... G09F 3/005
2018/0049483 A1 * 2/2018 Shore ..... A41D 1/22
2018/0064184 A1 * 3/2018 Kuo ..... A61F 5/37
2018/0116302 A1 * 5/2018 Hines ..... A41D 1/215
2018/0116314 A1 * 5/2018 King ..... A41D 27/20
2018/0279951 A1 * 10/2018 Asnis ..... A41D 13/0015
2019/0014836 A1 * 1/2019 Zingaro ..... A41D 13/1245
2019/0045849 A1 * 2/2019 Takasaki ..... A41D 1/21
2019/0183188 A1 * 6/2019 Mougey ..... A41D 1/215
2019/0364992 A1 * 12/2019 Thomas ..... A61F 13/53
2020/0046047 A1 * 2/2020 Bentley ..... A61M 25/02
2020/0154801 A1 * 5/2020 Burke ..... A41D 13/1245
2021/0022419 A1 * 1/2021 Carter ..... A41D 13/1254
2021/0145091 A1 * 5/2021 Gambon ..... A41D 13/129
2021/0212394 A1 * 7/2021 Wu ..... A41D 13/1245
2021/0378319 A1 * 12/2021 Korte ..... A41D 1/215
2021/0401094 A1 * 12/2021 Clemens ..... A61M 60/90
2022/0132963 A1 * 5/2022 Hinde ..... A41D 1/22 2/105
2022/0192281 A1 * 6/2022 Houston ..... A41D 1/215
2022/0248778 A1 * 8/2022 Crystal ..... A41D 1/215
2022/0378122 A1 * 12/2022 Crystal ..... A41D 1/215

FOREIGN PATENT DOCUMENTS

WO WO 2021/183471 9/2021
WO WO-2021183471 A1 * 9/2021

* cited by examiner

GARMENT FOR ASSISTING HOLDING AN INFANT

CROSS-REFERENCE TO RELATED APPLICATIONS

This application claims priority to U.S. Patent Application No. 63/146,122 filed Feb. 5, 2021, the content of which is incorporated herein by reference in its entirety.

FIELD OF THE INVENTION

The present invention relates generally to medical garments and methods for carrying an infant to provide skin-to-skin contact between the user and the infant.

BACKGROUND OF THE INVENTION

Infants often require hospitalization and some may require the care of a neonatal intensive care unit (NICU). Skin-to-skin contact, or kangaroo care, between the infant and a patient (e.g., the mother) has been known as a valuable therapy for infants. However, many neonatal intensive care units may have barriers to practicing skin-to-skin contact. Lack of devices, methods, techniques, wire or tubing management, and patient modesty are some examples of barriers to such contact.

Skin-to-skin contact is important because oxytocin and milk production may be increased with a mother holding her infant. Many infants in the NICU have an endotracheal tube or CPAP tube attached to their body, making breastfeeding impossible. In addition, most premature babies do not know how to breastfeed yet, so they need a feeding tube instead. Therefore, giving mothers the opportunity to capture their milk via a pump while performing skin-to-skin contact is important, particularly in the NICU. Since mother's milk provides numerous benefits to the infant's health, the mother having the option to pump while holding her infant in skin-to-skin contact can be extremely valuable for the long-term health of the infant.

Infants often have various important tubing attached to them when they are in the care of the NICU. In many ways, these tubing arrangements can hinder skin-to-skin practices or disturb a mother and her infant. For example, condensation in CPAP tubing can build up over time due to suboptimal positioning of the tubing. As a result, a NICU nurse may have to empty the tubing often, disturbing the patient and their infant. Other checks on the infant may occur hourly, adding more disturbance to the patient and their infant.

As such, a need exists for devices and methods that can allow a patient to practice skin-to-skin contact with their infant while managing the medical equipment or tubing attached to the infant. There also exists a need for devices and methods that allow a nurse to check on the infant without disturbing skin-to-skin contact between the infant and the patient or disturbing the modesty of the patient.

SUMMARY OF THE INVENTION

One variation of a garment for assisting a user holding an infant may include a first portion and a second portion configured to overlap the first portion when the garment is worn by the user. The first portion may define an elongated opening. The elongated opening may be positioned to provide access through the opening and to the infant from the outside of the garment while the first portion remains covered by the second portion. The garment may also include a first sleeve and a second sleeve. The first sleeve and the second sleeve may each extend from the first portion and the second portion respectively. The garment may also include at least one fastener attached to the garment. The at least one fastener may be positioned relative to the opening to secure at least part of a tubing or wire extending from the infant.

The at least one fastener may comprise a locking mechanism. The locking mechanism may be configured to pull away from the user when the locking mechanism transitions from a locked configuration to an unlocked configuration. The garment may have a plurality of fasteners. The plurality of fasteners may each comprise a plurality of loops each configured to hold at least part of the medical tubing extending from the infant. The plurality of loops on one fastener may extend at different angles with respect to the plurality of loops on another fastener. The plurality of fasteners may each comprise a locking mechanism configured to pull away from the user when the locking mechanism transitions from a locked configuration to an unlocked configuration.

The elongated opening may extend vertically along the front portion. The elongated opening may extend horizontally along the front portion. The at least one fastener may comprise a plurality of loops configured to hold at least part of the tubing extending from the infant. The plurality of loops may each be placed at different angles with respect to the at least one fastener. The at least one fastener may be configured to be detached from the garment. The at least one fastener may be configured to be repositioned on the garment. The garment may include a second elongated opening on the second portion. The second elongated opening may be positioned to provide access through the opening and to the infant from outside of the garment. The at least one fastener may be attached to the garment at the first portion and the first sleeve. The garment may further comprise sensing fabrics configured to monitor physiological characteristics of the user and the infant. The at least one fastener may be L-shaped. The at least one fastener may be T-shaped. The at least one fastener may have a substantially straight shape. The at least one fastener may be located on the first sleeve. The at least one fastener may be located on the second sleeve.

The garment may include a cover. The cover may be secured to at least a portion of a support for supporting the user. The cover may have a back portion, a front portion, a side portion, and at least one cover fastener attached to the cover. The at least one cover fastener may be positioned relative to the opening to secure at least part of the tubing or wire extending from the infant.

One variation of a method of assisting a user holding an infant may include placing a garment around the user and the infant. The garment may have a first portion, a second portion, a first sleeve extending from the first portion, and a second sleeve extending from the second portion. The method may also include overlapping the first portion with the second portion when the garment is worn by the user while holding the infant. The first portion may define an elongated opening which is positioned to provide access through the opening and to the infant from outside of the garment while the first portion remains covered by the second portion. The method may also include securing at least part of a tubing or wire extending from the infant with at least one fastener positioned relative to the opening.

The method may also comprise locking the at least one fastener with a locking mechanism. The locking mechanism may be configured to pull away from the user when the locking mechanism transitions from a locked configuration to an unlocked configuration. The garment may comprise a plurality of fasteners. The at least one fastener may comprise a plurality of loops each configured to hold at least part of the tubing extending from the infant. The plurality of loops may each be placed at different angles with respect to the at least one fastener. The method may also comprise detaching the at least one fastener from the garment. The at least one fastener may be configured to be repositioned on the garment.

Another variation of the garment for assisting a user holding an infant may include a first portion, a second portion, a back portion, a first sleeve, and a second sleeve. The first sleeve may extend from the first portion. The second sleeve may extend from the second portion. The first portion may define an elongated opening positioned to provide access through the opening and to the infant from outside of the garment while the first portion remains covered by the second portion. The opening may be at least partially closed with at least one tab.

The garment may include a first fastener attached to the garment at the first portion. The first fastener may have an L-shape. The first fastener may comprise a locking mechanism. The first fastener may comprise a plurality of loops each configured to hold at least part of the medical tubing extending from the infant.

The garment may include a second fastener attached to the garment at the second portion. The second fastener may have an L-shape. The second fastener may comprise a locking mechanism. The second fastener may comprise a plurality of loops each configured to hold at least part of the medical tubing extending from the infant.

The garment may include a third fastener attached to the garment at the first portion and the back portion. The third fastener may have a T-shape. The third fastener may comprise a locking mechanism. The third fastener may comprise a plurality of loops each configured to hold at least part of the medical tubing extending from the infant.

The garment may include a fourth fastener attached to the garment at the second portion and the back portion. The fourth fastener may have a T-shape. The fourth fastener may comprise a locking mechanism. The fourth fastener may comprise a plurality of loops each configured to hold at least part of the medical tubing extending from the infant.

The fasteners may have various shapes, including a straight shape. The fasteners may also have various modes of use with the different components of the garment.

DETAILED DESCRIPTION OF THE INVENTION

Various exemplary medical garments and methods are provided for holding an infant in a manner that provides skin-to-skin contact between the user and the infant while managing tubing attached to the infant. In general, the methods and devices allow an infant to be securely held against the user's chest to provide the benefits of skin-to-skin contact, while managing different size tubing or wires around the body of the user.

Figure 1A:
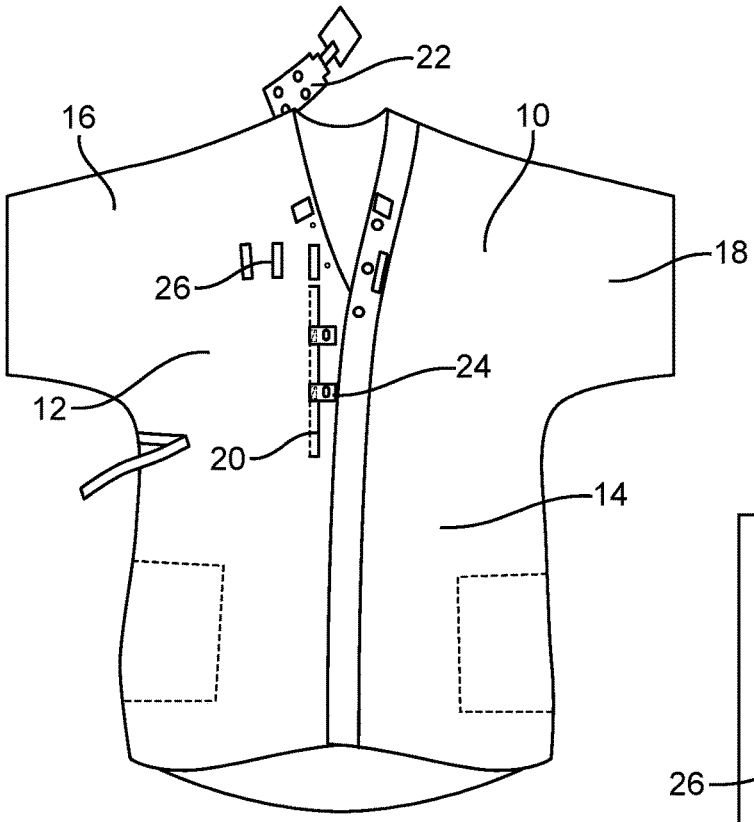
FIG. 1A shows a front view of a medical garment.

FIG. 1A shows one exemplary embodiment of a medical garment 10. The medical garment 10 may comprise a first garment portion 12, a second garment portion 14, a first sleeve 16, and a second sleeve 18. The garment may be in the form of a shirt, blouse, or the like and may be worn as such. Sleeves 16 and 18 may be configured in any suitable manner, for example, as oversized or kimono-like sleeves for comfortability. The first portion 12 and the second portion 14 may be configured to wrap around or overlap each other to cover the user and the infant while maintaining skin-to-skin contact. As will be further described herein, various fasteners 22 may be attached on the garment 10 to manage and secure various tubes or wires which are attached to an infant. Similarly, the garment 10 can have loops 26 to manage and secure such tubes. The loops 26 may be placed at any angles and in any configurations on the garment 10. Additionally, loops 26 may comprise attachable hook-and-loop fastener (e.g., VELCRO®) holders that may attach tubes within the loops and to the fasteners 22. The hook-and-loop fastener holders may optionally secure the tubing 28 in one or more places along the garment 10. Alternatively, tubing may be gathered with a secure tie which ties the tubing onto the loops 26.

Figure 1B:
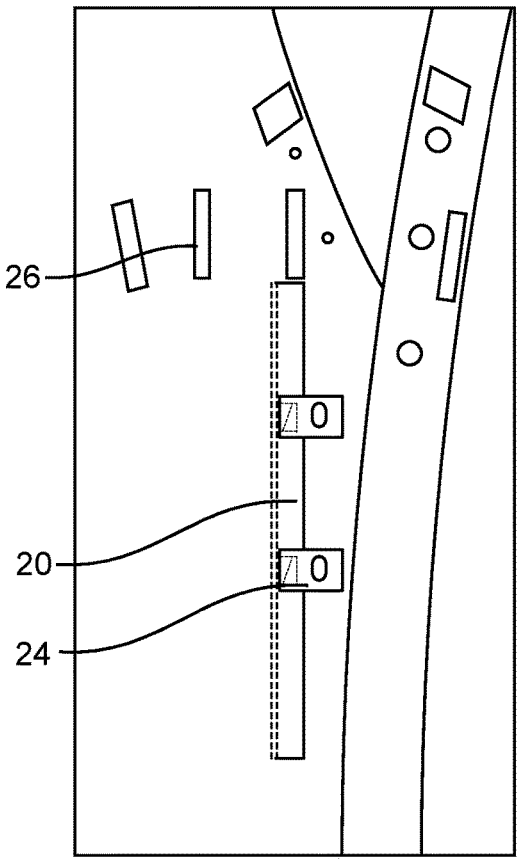
FIG. 1B shows a close-up front view of the medical garment.

As shown in FIG. 1B, the medical garment 10 may have an opening 20 that provides access to an infant while the user is holding the infant. The opening 20 may be in the range of, e.g., 5 to 10 inches, or more specifically, e.g., 5 to 8 inches, but may have a variety of different lengths as appreciated by a person having ordinary skill in the art. Additionally, the opening 20 may be positioned vertical, horizontal, or at an angle with respect to the garment 10. FIG. 1B shows the opening 20 positioned on the first portion 12, however, the opening may optionally be positioned on the second portion 14. Alternatively, there may be an opening 20 on both the first portion 12 and the second portion 14.

The opening 20 may be positioned on the garment in a location where an outside user or practitioner (e.g., a nurse, doctor, etc.) may have access to the infant. For example, an infant may be in skin-to-skin contact with the user such as a patient, mother, or care-provider while the nurse may check the infant through opening 20 without interrupting contact between the infant and the user. The user may remain covered while a nurse accesses the infant through opening 20. Some examples of checks on the infant may be for documenting wounds, lines, epidurals, and adjusting pulse oximeter and/or other devices as needed. The opening 20 may also allow a nurse to perform heel sticks and other procedures on the infant while the infant is comforted during such procedures.

The opening 20 may be useful for additional purposes beyond evaluating the infant. One such purpose may be to allow for a mother to capture milk using breast pump flanges during skin-to-skin contact. Because oxytocin and milk production are increased during skin-to-skin contact, it may be desirable to allow for breast pump flanges to easily pass through the opening 20. Further, premature infants may need to feed through a feeding tube. Other infants in the NICU may have an endotracheal tube or another tube attached to them, making breastfeeding almost impossible. Therefore, offering the user the option to pump while holding the infant may be valuable for the infant's long-term health.

The opening 20 may have a number of tabs 24 that may open and close portions of the opening 20. The tabs 24 may be positioned over the opening 20 to facilitate access to check on infant or to introduce breast pump flanges without disturbing the infant or the patient. The tabs 24 do not require that the nurse or other user to push on the tabs to close them. Instead, tabs 24 may incorporate a lift-up snap closure feature designed to pull away from the infant so that closing the tabs 24 does not push on the fragile skin of the infant. The tabs 24 may also provide a closure mechanism so that the infant may be prevented from falling out of the opening 20 when being held by the user.

The garment may be intended for use in the NICU but may also be used in an adult or pediatric ICU with various patient populations. The configurations of the opening 20, the fasteners 22, the tabs 24, and the loops 26 of the garment 10 may vary based on where tubes are being managed and prevented from being pulled. For example, for adult patients (i.e., patients not carrying an infant), a horizontal opening on the garment may be used. Other garments may have special pockets for equipment (e.g., telemetry) and may also use biomedical sensor fabric within.

Figure 2A:
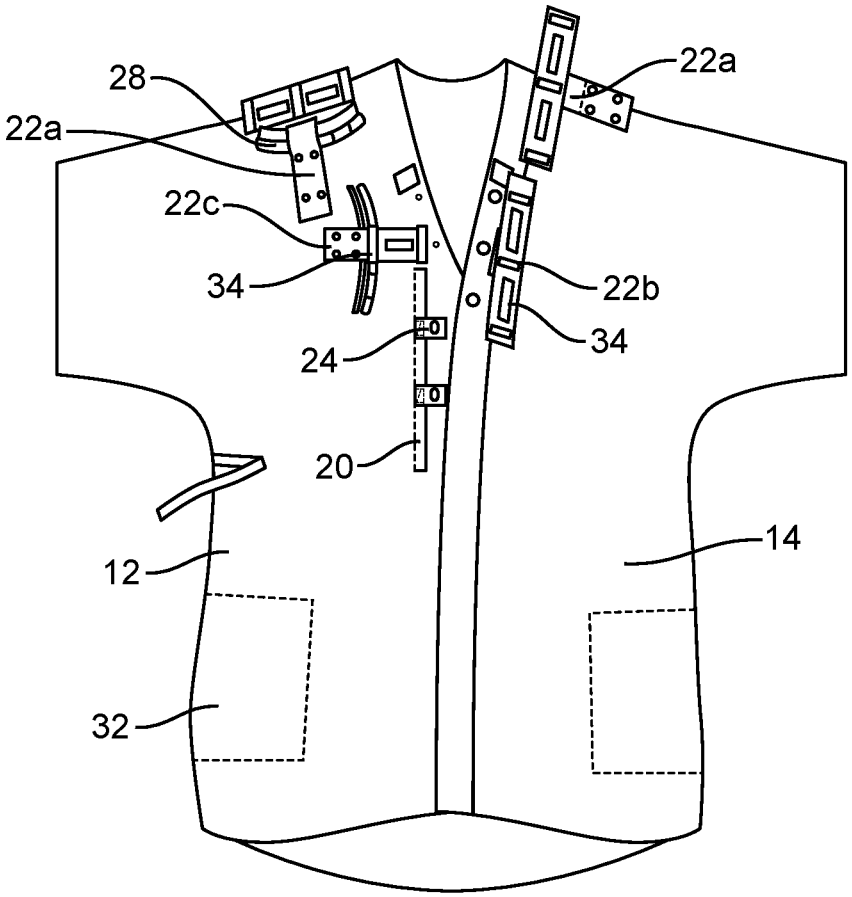
FIG. 2A shows a front view of another variation of the medical garment.

FIG. 2A shows another variation of the medical garment 10 having fasteners 22 attached thereto. Fasteners 22 may be strategically placed on the garment 10 depending on need. For example, some fasteners (e.g., fastener 22*a*) in FIG. 2A are placed on the garment 10 where the patient's shoulders would be in order to allow for placement of tubing away from the infant. As seen in FIG. 2A, those fasteners 22 may be placed over the shoulder attached to the back side of the garment 10 or completely on the front portion of the garment 10. Other fasteners (e.g., fasteners 22*b* and 22*c*) may be placed on the garment closer to the opening 20 to allow for easier positioning of tubing near the infant. Similar to opening 20, fasteners 22 may have tabs 24 that lift away from the infant to secure and hold the tubing in at least one place. Fasteners 22 may also have various configurations and shapes, as will be further described herein.

Figure 2B:
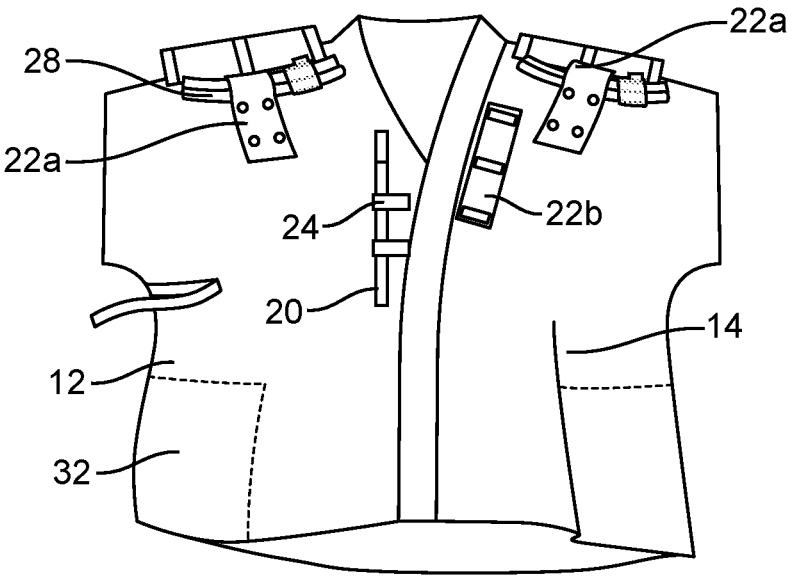
FIG. 2B shows a front view of yet another variation of the medical garment.

To hold medical tubing attached to the infant, the fasteners 22 may comprise fastener loops 34. The fastener loops 34 may be strategically placed on a surface of the fastener (see fastener 22*b*, for example) such that tubing 28 may be passed through the fastener loop 34 without added manipulation of the fastener 22 itself. Alternatively, fastener loops 34 may be placed within the fastener surface (see fastener 22*c*, for example) such that tubing 28 may be passed through the fastener 22 itself. This may allow for more security and stability of the tubing 28 when held within the fastener 22. Tubing 28 may also be attached to the back or shoulder portion of the garment 10 to increase security. Increased security may decrease the risk of tubing being pulled out from their proper position or being moved and pulled on the infant's face or body. FIG. 2B shows another variation of garment 10 where the fasteners 22*a* on the shoulder of the garment are both placed on the front side of the garment 10.

Figure 3:
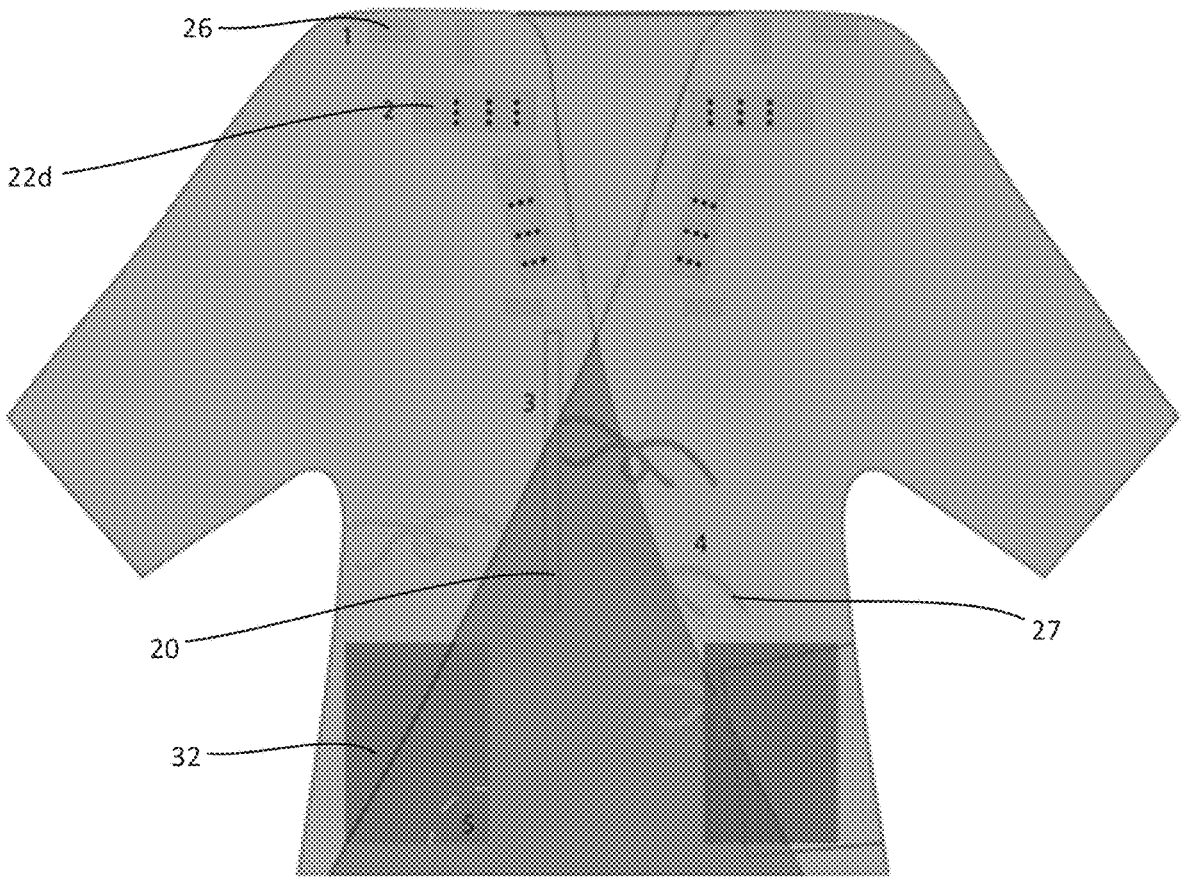
FIG. 3 shows a front view of yet another variation of the medical garment having pockets.

FIG. 3 shows yet another variation of the medical garment 10 having loops 26 near the shoulder area of the garment 10. Fasteners 22*d* may be placed around the neck area of the garment 10, or near opening 20. Loops 26 may also be placed near opening 20, which may also have tubing passing through. It should be understood that the placement, shape, and quantity of the fasteners 22 and loops 26 on the garment 10 can be customizable based on the desired tubing or wire management.

Garment 10 may also include pockets 32 positioned on the first garment portion 12, the second garment portion 14, or both portions. The pockets 32 may be placed towards the lower part of the garment 10 so as to not interfere with tubing or wiring when the pocket 32 is being accessed by a user or a nurse. The placement and specific size of the pocket 32 on the garment may be designed to house various biomedical sensors and/or a telemetry box. Biomedical sensors may be used for gathering pathological and/or physiological information of the infant or the patient. In addition, biomedical sensor fabrics may be used on the garment 10 which may directly monitor vital signs or sounds such as bowel sounds of the infant. These sensors may be added to the garment 10 in such a way to make skin-to-skin time more comfortable and safe for both the infant and the patient. However, it should be appreciated that any fabric may be used for the garment. Additionally, in order to maintain the garment 10 in a closed configuration upon the user, one or more color-coded fasteners or ties 27 may be provided on the garment to hold the first and second portions in a closed configuration when in use upon the user.

Figure 4:
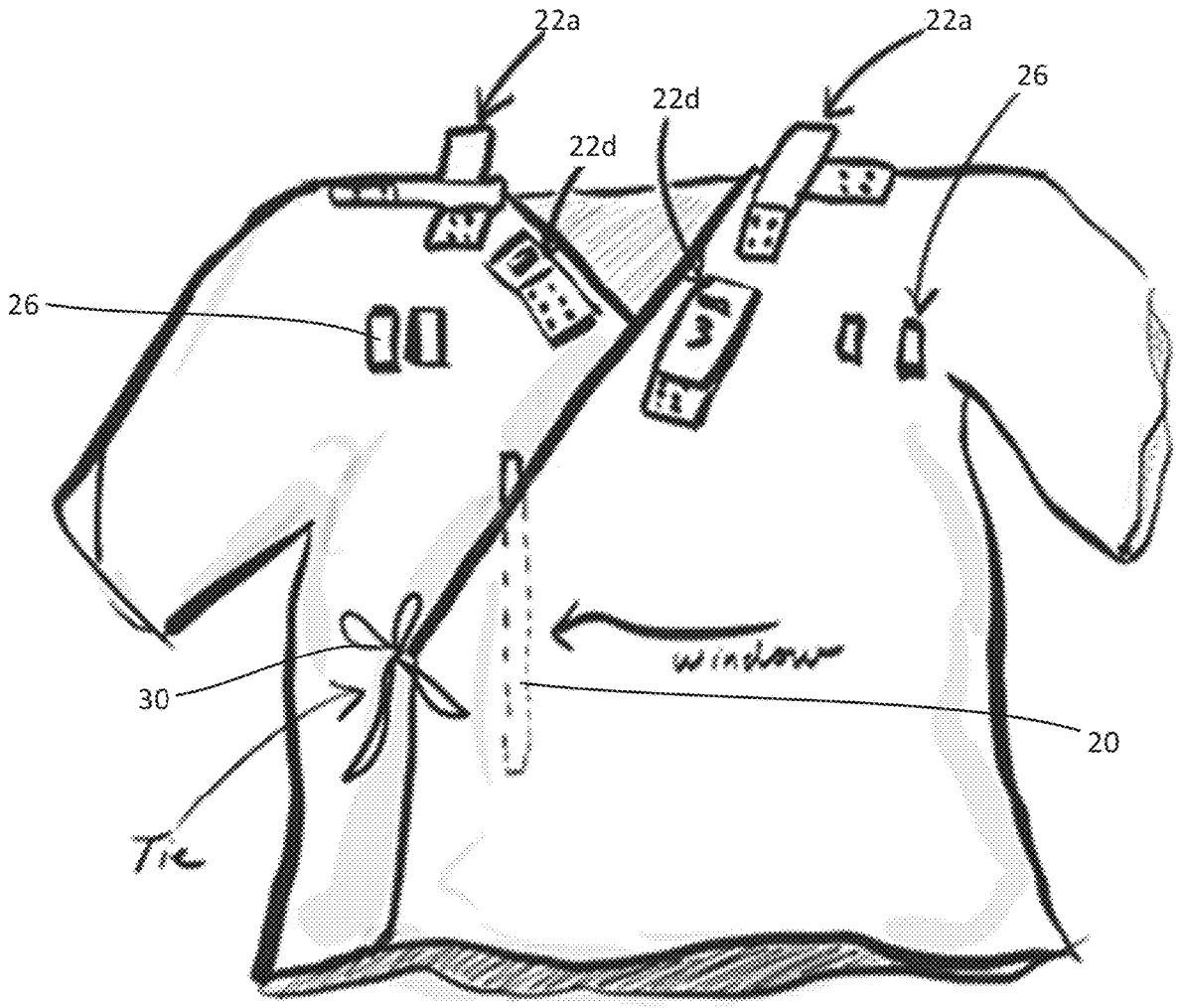
FIG. 4 shows a front view of yet another variation of the medical garment having a tie attached to the garment.

FIG. 4 shows yet another variation of the medical garment 10 having another combination of fasteners 22 and loops 26 positioned on the garment 10. In this embodiment, fasteners 22*a* may be placed over both shoulders of the garment 10, extending to the backside of the garment. Fasteners 22*d* may be placed near the neck area of the garment. Loops 26 may be positioned on both the first portion 12 and the second portion 14 in order to route tubing or wiring on both sides of the garment 10.

The first portion 12 and the second portion 14 may also be connected or secured together by a tie 30. The tie 30 may be colored or color-coded to allow for easier manipulation of the tie 30 when the garment 10 is holding and managing multiple tubes. Tying the front portion 12 and the second portion 14 together may also allow for increased modesty coverage for the patient. Methods of tying may be accomplished by strings attached the front portion 12 and the second portion 14 or any modifications or variations of tying thereof.

Figure 5:
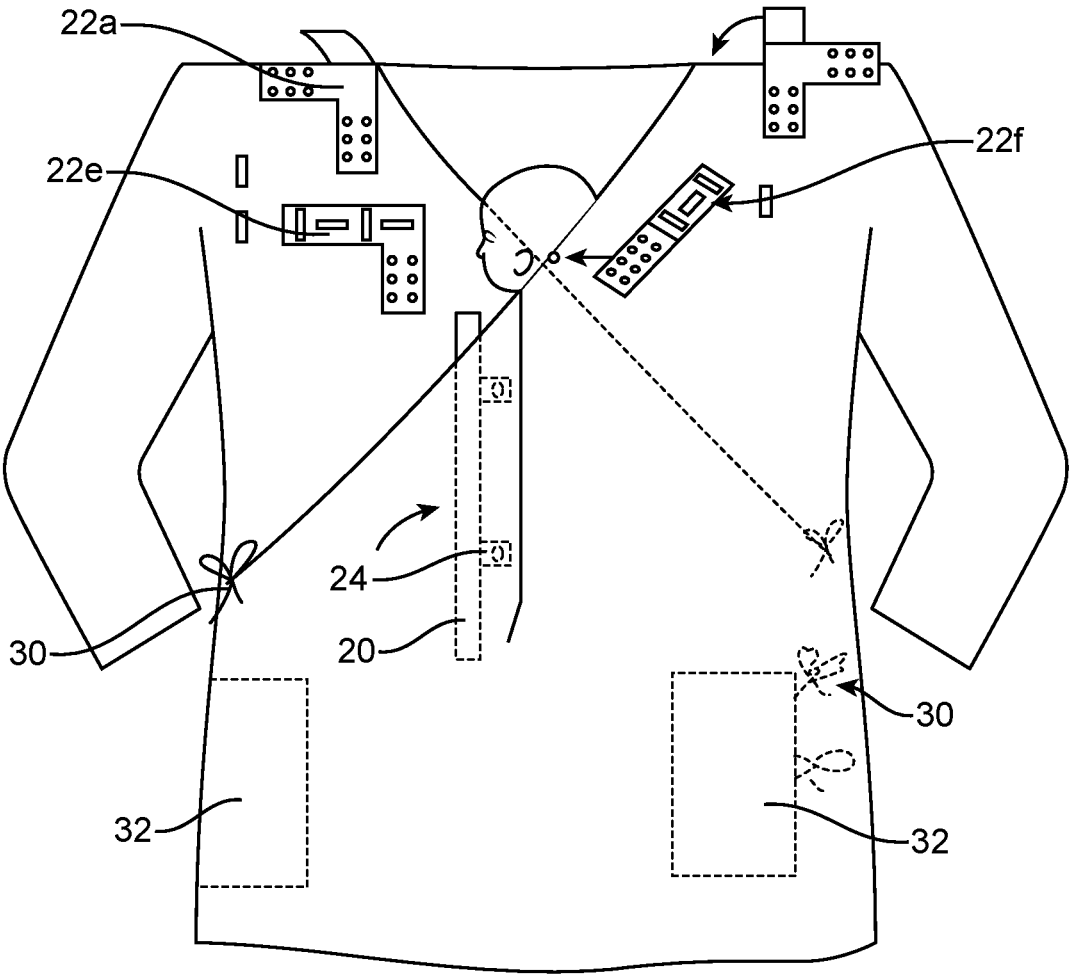
FIG. 5 shows a front view of yet another variation of the medical garment.

FIG. 5 shows yet another variation of the medical garment 10 having fasteners 22*a* placed over the shoulder of the garment 10 and fasteners 22*e* and 22*f* placed closer to the opening 20 of the garment. As seen in FIG. 5, the infant may be placed near the opening 20 to facilitate checks on the infant without uncovering the patient. Additionally, tie 30 may allow the first portion 12 and the second portion 14 to optionally hold together to provide additional privacy for the patient. Loops 26 may also be placed around the garment for extra securement and management of tubing or wires.

Figure 6A:
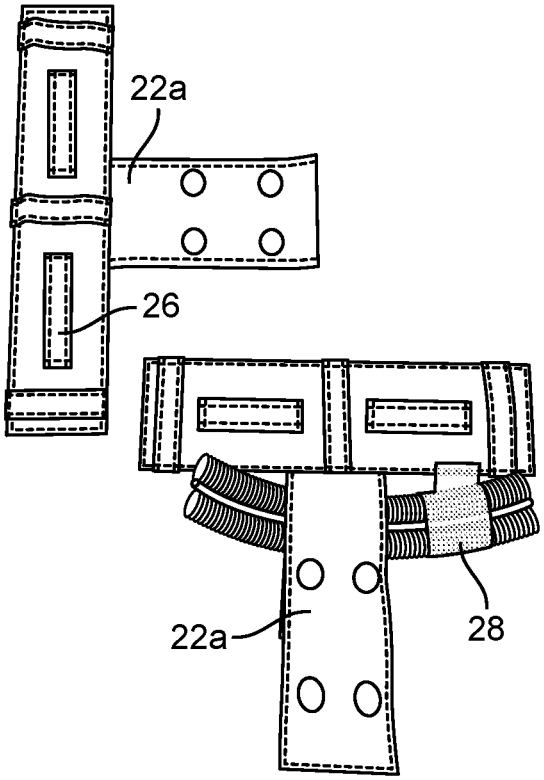
FIGS. 6A to 6J show front views of various fasteners and fastener components that can be attached to the medical garment.

FIGS. 6A to 6J show close-up views of various fasteners and combinations of components of fasteners in further detail. FIG. 6A shows fastener 22*a*, which may have a T-shape or have a substantially T-shaped configuration. As seen in embodiments of garment 10, the T-shaped fasteners 22*a* may be placed on the shoulder portion of the garment 10. It should also be understood that the fasteners may be placed anywhere on the garment 10 according to desired tubing and wire management. Fasteners 22*a* may include a portion having loops 26 to hold tubing along an outer surface of the fastener 22*a* and another portion having tabs 24 to hold tubing 28 within the fastener.

Figure 6B:
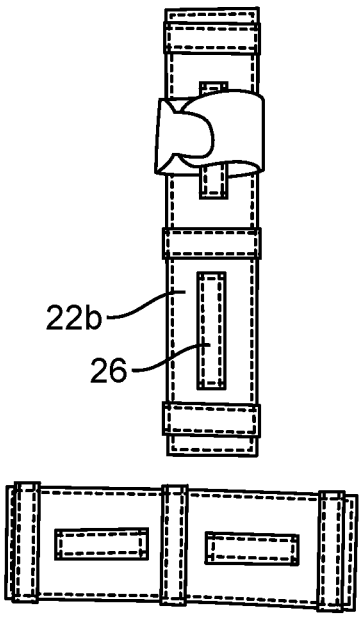
Figure 6C:
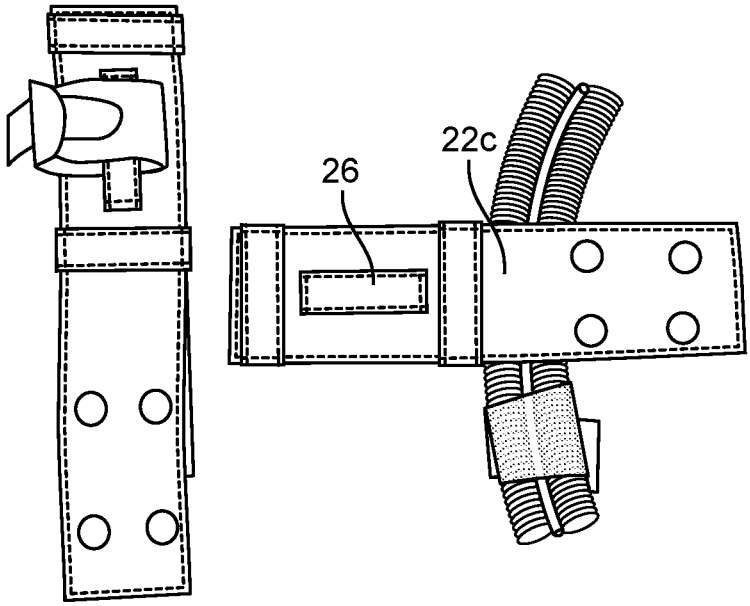

FIG. 6B shows views of fastener 22*b*. Fastener 22*b* may be configured in a straight or substantially straight configuration. Similar to the T-shaped fastener 22*a*, the straight fastener 22*b* may have loops 26 to hold tubing along an outer surface of the fastener. FIG. 6C shows fastener 22*c*, which may also be a straight fastener. Fastener 22*c* varies from fastener 22*b* in that one portion of the fastener 22*c* may comprise tabs 24 to facilitate passing tubing 28 within the fastener. The fasteners may be configured in various configurations, such as VELCRO® fasteners, hook and eye fasteners, and the like.

Figure 6D:
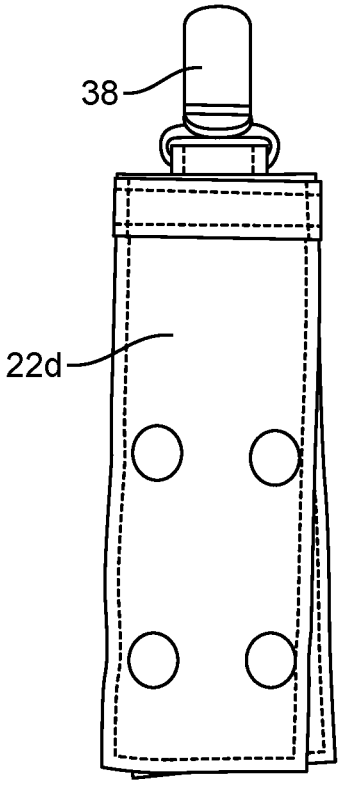

FIG. 6D shows yet another variation of a fastener. Fastener 22*d* may be configured as having a straight shape having tabs 24 to hold a tubing within the fastener. A clip 38 may be attached to fastener 22*d*. Clip 38 may be used to enable the fastener to attach anywhere onto garment 10. The clip 38 may be actuated by hand allowing for the fastener 22*d* to be easily repositionable along the garment 10 if a different configuration of tubing management is desired. It should be understood that clip 38 may be used among all of the different variations of fasteners and may be positioned on any location of the fastener itself.

Figure 6E:
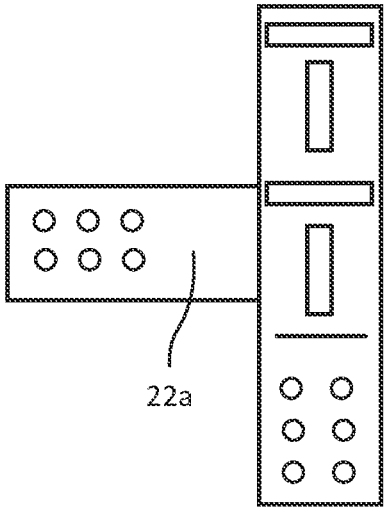
Figure 6F:
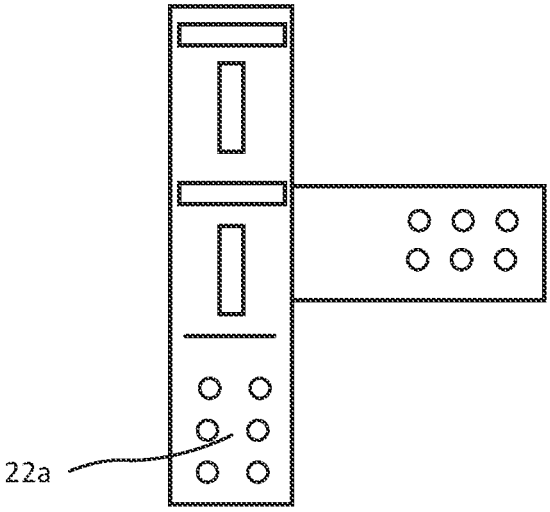

FIGS. 6E and 6F show yet another variation of a T-shaped fastener 22*a* with an extra section having tabs 24 extending therefrom. The fasteners shown in FIGS. 6E and 6F may be configured for right and left shoulders, respectively, though it should be understood that the fasteners may be used at any location on the garment.

Figure 6G:
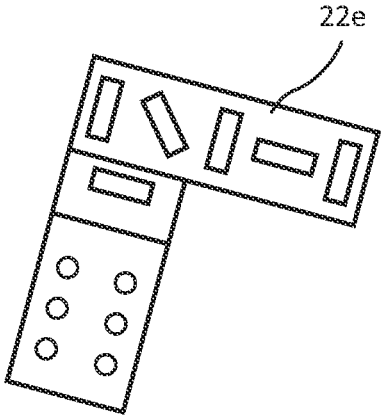
Figure 6H:
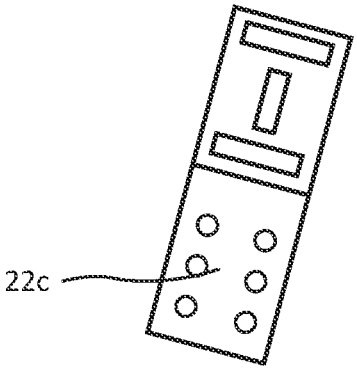

FIG. 6G shows yet another variation of a fastener, fastener 22*e*, which may have an L-shape or have a substantially L-shaped configuration. As seen in FIG. 6G, the loops 26 of fastener 22*e* may be positioned along the fastener. Additionally, loops 26 may have different angles and different lengths as desired for tubing management. For example, the loops may be placed and secure tubing with respect to the position of various machines in a hospital room. The fastener 22*e* may also have tabs 24 to hold tubing within the fastener itself. FIG. 6H shows yet another variation of the substantially straight fastener 22*c* of FIG. 6C having additional tabs 24.

Figure 6I:
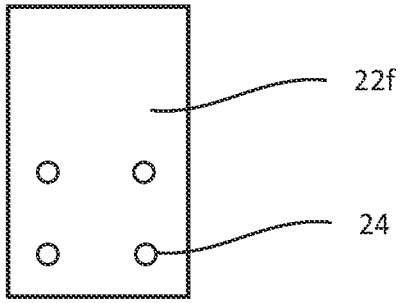
Figure 6J:
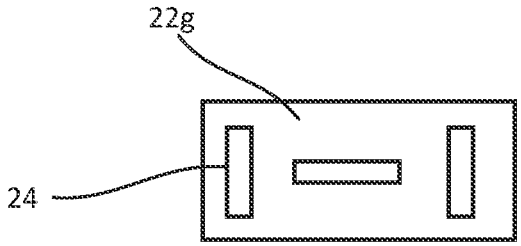

Fasteners 22 are made using components shown in FIGS. 6I and 6J. FIG. 6I shows fastener component 22*f* which may have any number of tabs 24 to hold tubing with the fastener. FIG. 6J shows fastener component 22*g* which may have any number of loops 26 positioned to hold tubing or hook-and-loop fasteners components on the surface of the fastener. Fasteners of different configurations shown in previous figures may also be created using various positioning and various quantities of the components shown. For example, the T-shaped fastener 22*a* shown in FIG. 6A may be created using two of fastener component 22*g* and one of fastener component 22*f* arranged in the configuration shown. It should be appreciated that any arrangement and any number of fastener components 22*f*, 22*g* may be used to create any shape, configuration, and/or quantity of fasteners to be used on the garment 10.

Figure 6K:
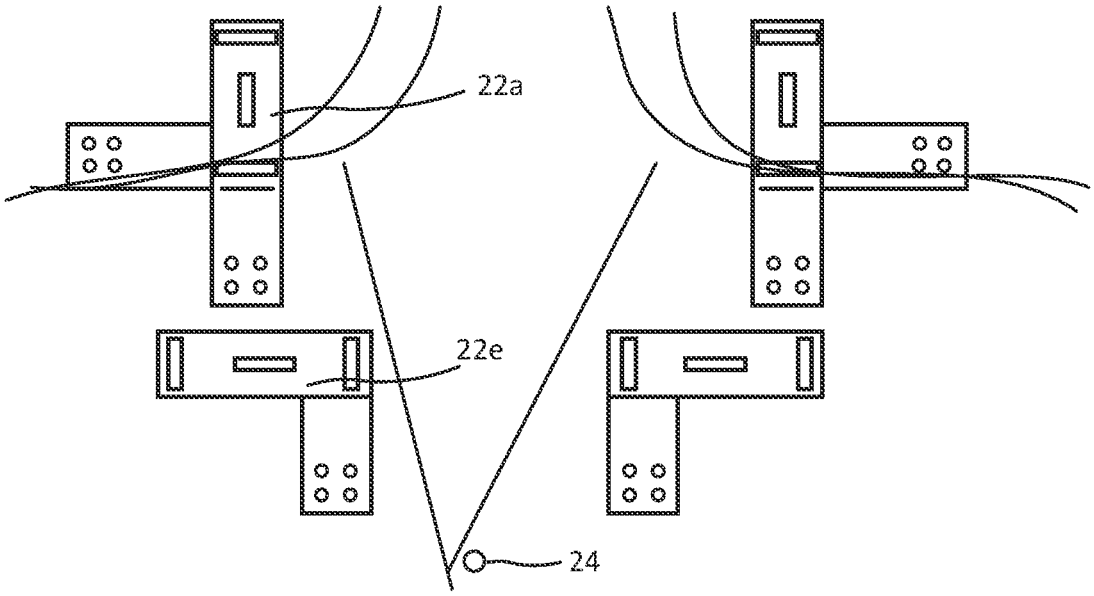
FIG. 6K shows a front view of yet another variation of the medical garment.

FIG. 6K shows yet another variation of a garment 10 with T-shaped fasteners 22*a* on either side of the garment 10 and L-shaped fasteners 22*e* on either side of garment 10. A tab 24 may also be placed on the first portion 12 or the second portion 14 to connect the portions together. This may allow the user to control modesty and discretion as desired.

Fasteners 22 may be attached onto garment 10 in any method. For example, the fasteners 22 may be sewn onto garment 10 at desired locations on the garment. As noted above, fasteners 22 may also be clipped onto the garment 10 for ease in repositioning the fastener. Other attachment means may be used as necessary.

Figure 7A:
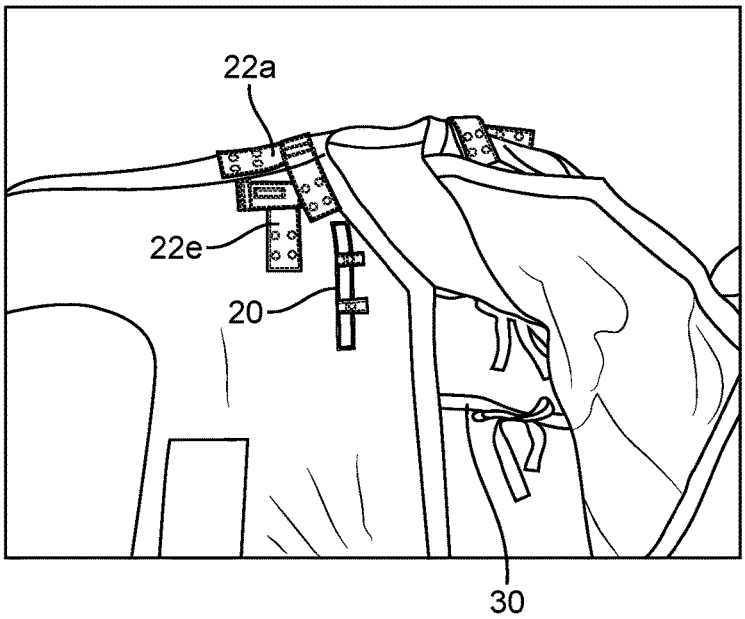
FIG. 7A shows a front view of yet another variation of the medical garment.
Figure 7B:
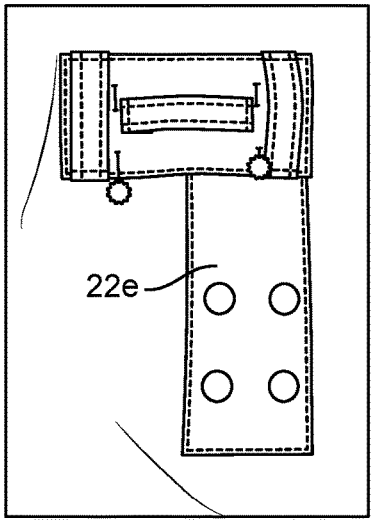
FIGS. 7B to 7D show front views of various fasteners and tabs that can be attached to the medical garment.
Figure 7C:
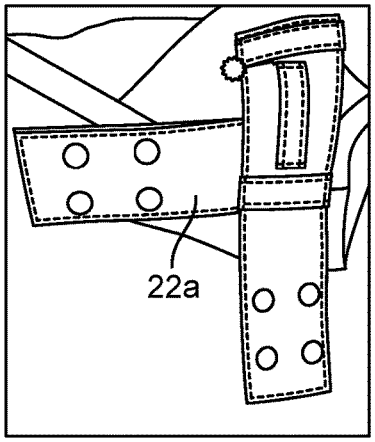
Figure 7D:
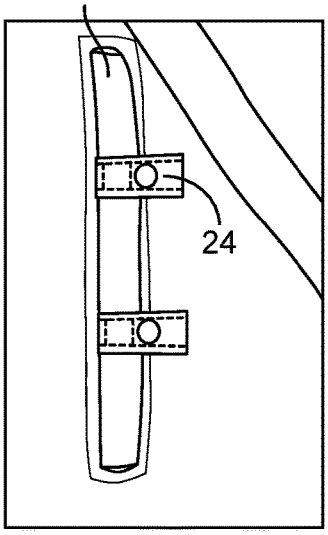

FIG. 7A shows yet another variation of a garment 10 with T-shaped fasteners 22*a* that may be placed on both shoulder portions of garment 10. L-shaped fastener may be placed on garment 10 closer to opening 20. As previously discussed, the garment 10 may be closed by tie 30 which may be colored to distinguish the tie 30 from any tubing. FIG. 7B shows another variation of an L-shaped fastener 22*e*. The fastener 22*e* may be attached to garment 10 by any suitable attachment means. Similarly, the T-shaped fastener 22*a* in FIG. 7C may be attached to garment 10 by any suitable attachment means. FIG. 7D shows a close-up view of opening 20 with tabs 24.

Figure 7E:
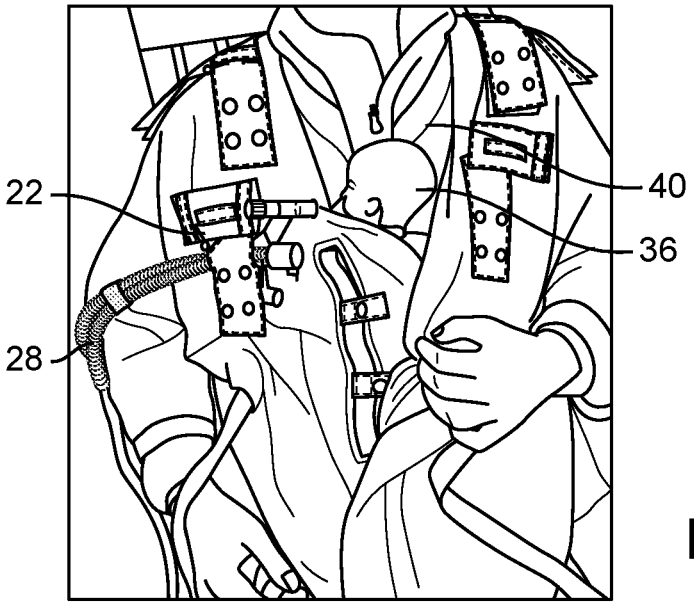
FIGS. 7E to 7G show perspective views of the medical garment in use by a patient holding an infant.
Figure 7F:
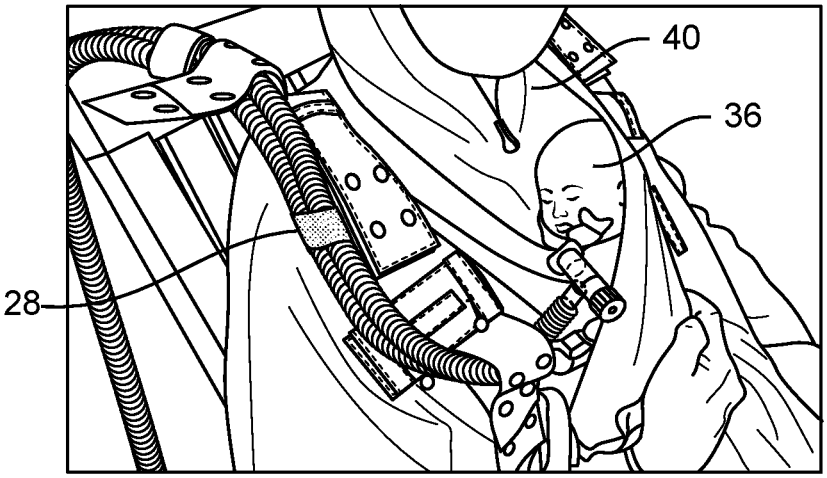
Figure 7G:
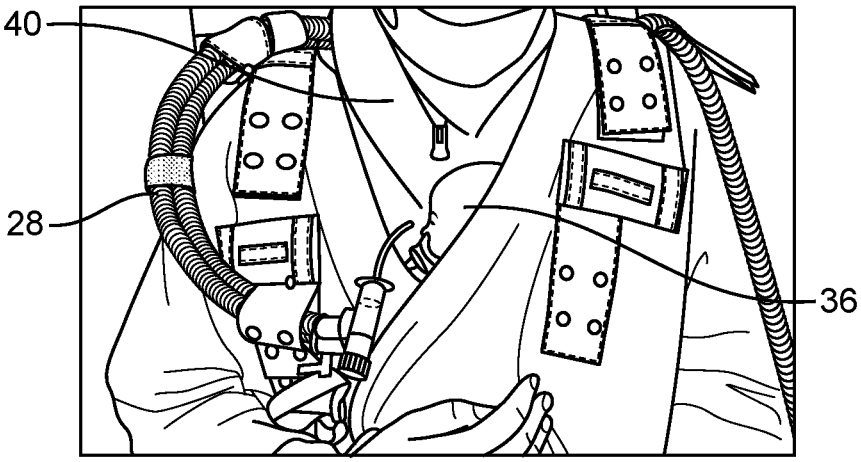

FIGS. 7E to 7G show perspective views of a user or patient 40 wearing garment 10 while holding an infant 36. As can be seen in FIG. 7E, the user 40 may hold the infant 36 close to her body while the infant 36 has tubing 28 attached thereto. As discussed above, the garment may have various configurations of fasteners 22 which may comprise tabs 24 and loops 26 that hold the tubing 28. Tubing 28 may be managed according to the desired positioning of the fasteners 22. For example, FIG. 7E shows a configuration in which the tubing 28 may be positioned such that the user's arm is free to move. Alternatively, FIGS. 7F and 7G show a configuration where tubing 28 is routed over the shoulder of user 40. Regardless of the location of the tubing, the infant 36 may be positioned within the garment 10 and the user 40 may be covered while maintaining skin-to-skin contact, all while the tubing is managed so as to not disturb the user 40 and the infant 36.

Figure 8:
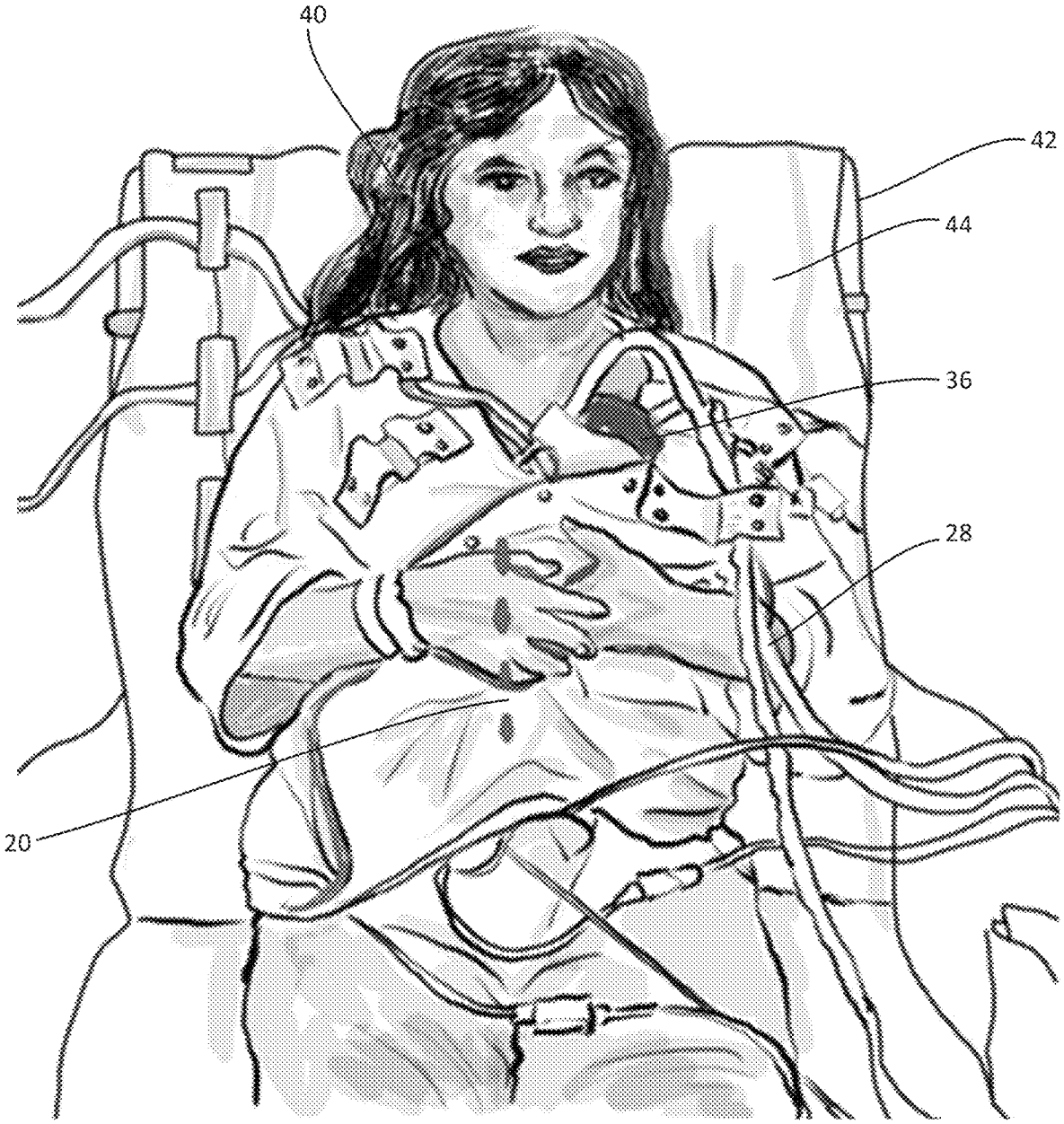
FIG. 8 shows a front view of the medical garment and a chair cover in use by a patient sitting in a chair holding an infant.

FIG. 8 shows a chair cover 44 that may be used in accordance with garment 10. The chair cover 44 may be placed over a chair 42, for example, a NICU chair. The chair cover 44 may incorporate various attachments as used with garment 10 such as the fasteners 22, tabs 24, and loops 26. The chair cover 44 may be adjustable for different sized recliner and rocking chairs. In addition, the chair cover 44 may allow for added management of tubing 28, more security from extubations and less weight and pulling on the user 40. This may eliminate the need for the user to have tubing 28 taped to their body to keep them in place. Additionally, the weight of the user 40 may hold the chair cover 44 in place during use. The chair cover 44 may thus allow the tubing 28 of the infant 36 to be secured in a second location for added safety.

Figure 9:
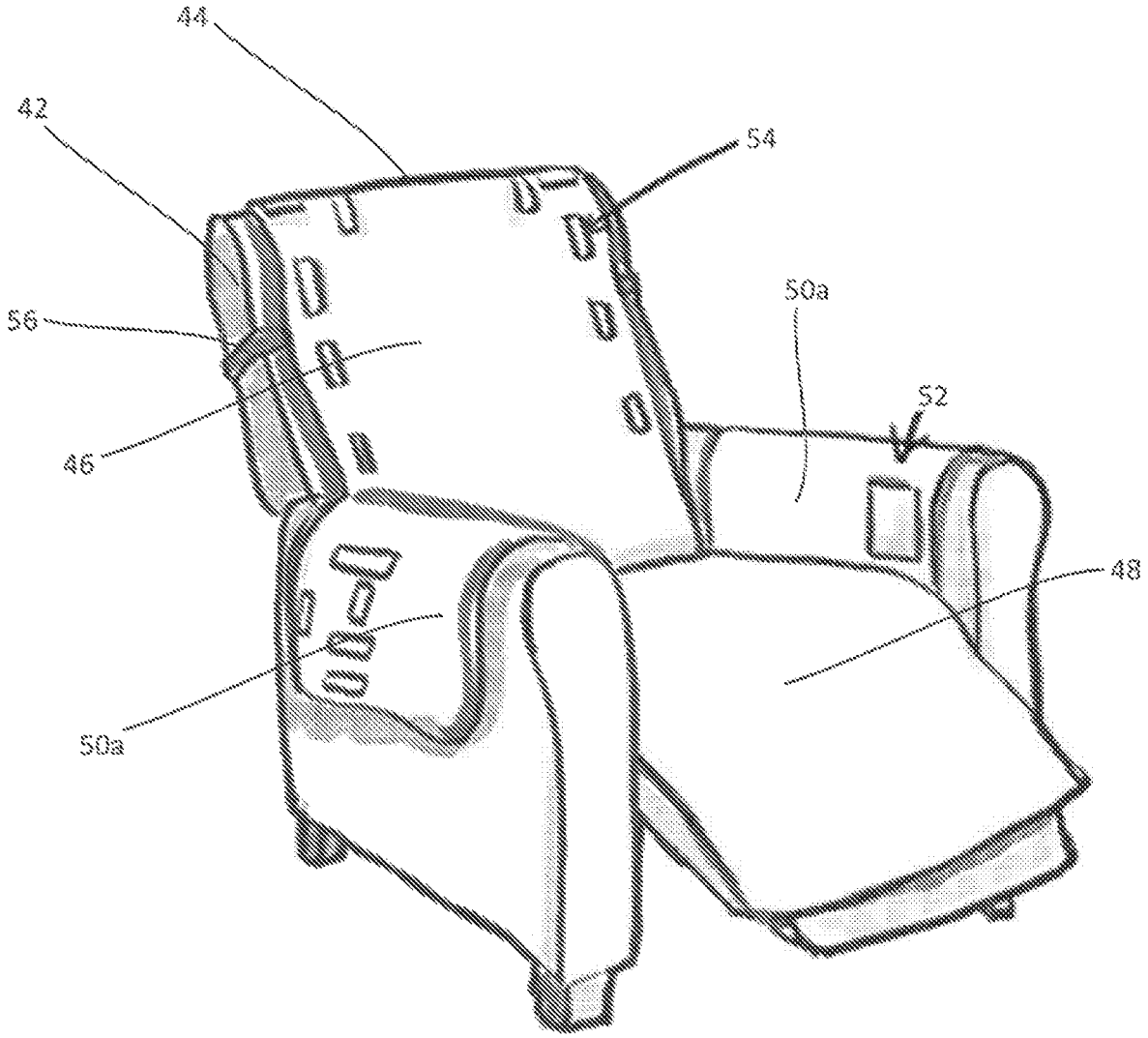
FIG. 9 shows a perspective view of a chair cover positioned over a chair.

FIG. 9 shows chair cover 44 placed on a chair 42. As seen in FIG. 9, the chair cover 44 may have a back cover 46, a seat cover 48, and arm covers 50*a* and 50*b*. The portions of chair cover 44 may be connected to each other by any suitable attachment means. The chair cover 44 may have a cover pocket 52 for the user to place her belongings (e.g., a cellular phone) while sitting in the chair 42. The chair cover 44 may have a number of cover loops 54 similar to the loops 26 on garment 10. The cover loops 54 may be repositionable and may be used to manage the tubing attached to the infant. The cover loops 54 may be positioned at different angles with respect to the chair 42. Additionally, the cover loops 54 may also have hook-and-loop fastener attachments that may attach tubes within loops 54, similar to loops 26 of fasteners 22. To attach the chair cover 44 to a chair, the chair cover 44 may have a cover fastener 56 attached to the back cover 46. The cover fastener 56 may comprise a strap that wraps around the back portion of chair 42, as seen in FIG. 9. It should be understood that chair cover 44 may have any number or configuration of fasteners 22, tabs 24, and loops 26 attached thereto.

The fasteners 22, tabs 24, and loops 26 of the garment 10 may also be configured as a pillow cover, for example, over a lap pillow. A pillow cover may allow the user's hands and arms to rest in a more natural position making it more comfortable ergonomically for the user while holding the infant in skin-to-skin contact for long periods of time. The pillow cover may be secured to the user around their waist using a belt buckle system or another suitable attachment means. Alternatively, the features of garment 10 may be used as an apron-like garment that is configured as a waist tied apron garment that may have additional fasteners 22, tabs 24, and loops 26 attached for more tubing security and management options.

Figure 10A:
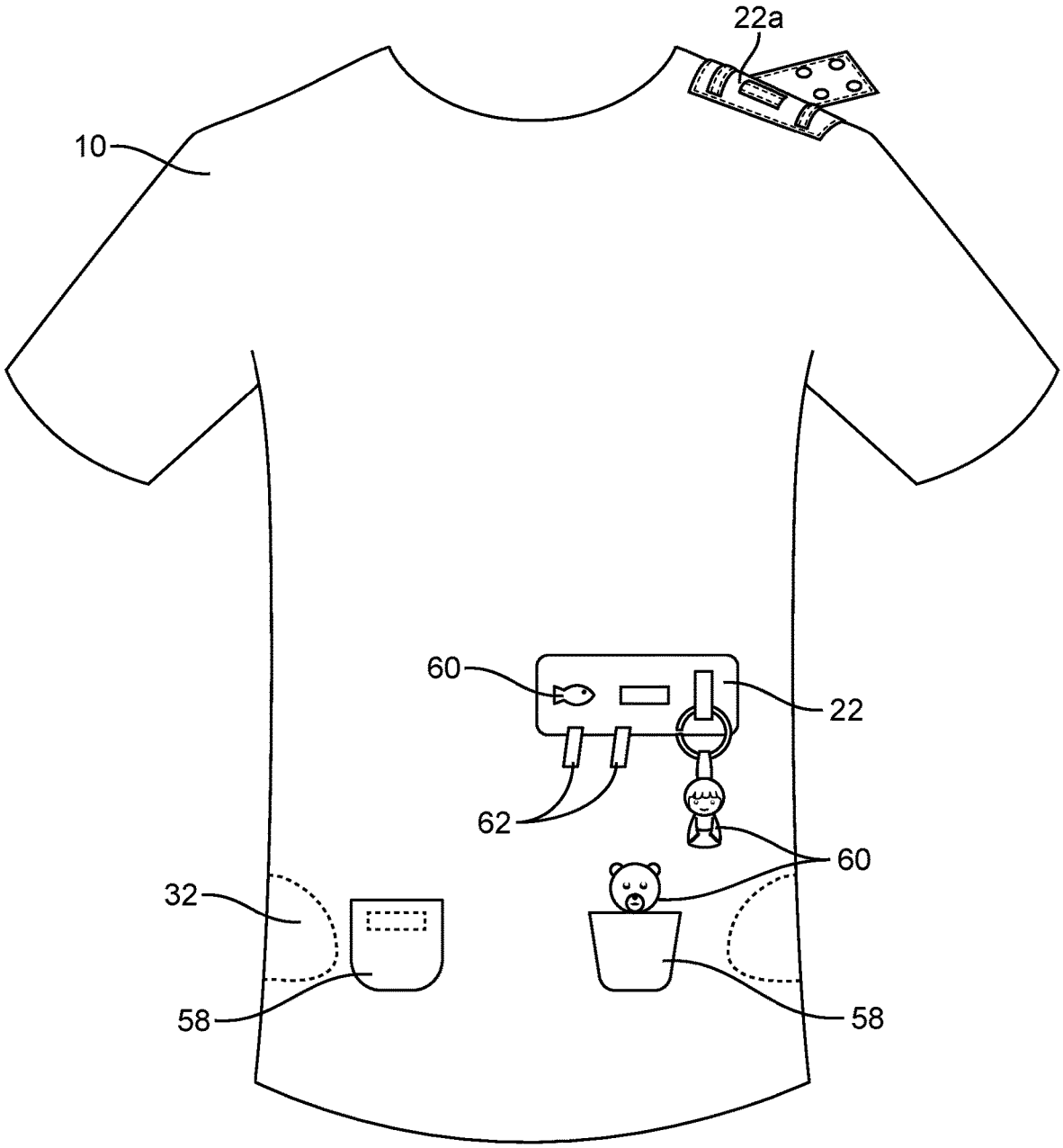
FIG. 10A shows a front view of yet another variation of the medical garment having infant toys attached thereto.

FIG. 10A shows garment 10 optionally having a plurality of toys 60 for the infant or child to interact with during care. This variation of the garment may have a plurality of toy pockets 58 and may be used in the pediatric ICU. The toy pockets 58 may be placed at the bottom of the garment 10, but it should be understood that pockets can be placed at any location on the garment. The pockets 58 may be attached to the garment by any suitable attachment means. The garment 10 may also have fasteners 22 attached to the garment 10 for the purpose of toys 60 being attached thereto. Any fastener 22 described herein may be used to facilitate the accessibility of toys 60. The fastener 22 may also have textured tags 62 hanging from and attached thereto for the infant to touch. Toys 60 and textured tags 62 may can have various effects on the infant, such as soothing the infant, distracting the infant through play, and enhancing motor skills.

Figure 10B:
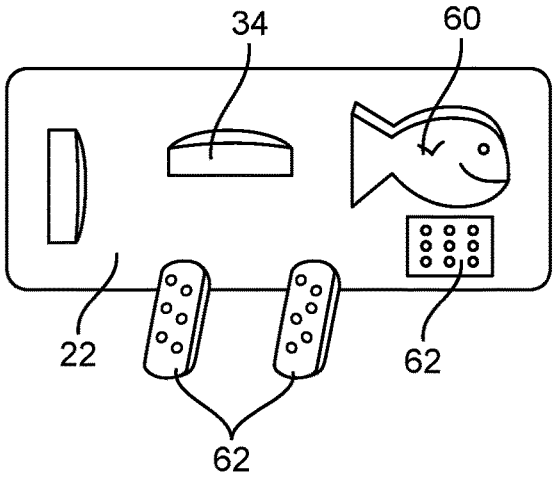
FIGS. 10B to 10J show various views of fasteners and pockets configured to attach toys and tabs to one variation of the medical garment.

FIG. 10B shows one example of a fastener having loops 26, toy 60, and textured tags 62. Toys 60 may be made of soft, puffy material and attached to the fastener 22 such that it extends outwardly from the garment 10. The textured tags 62 may be configured as any suitable material that is appropriate for infants to play with or stroke, such as standard ribbons.

Figure 10C:
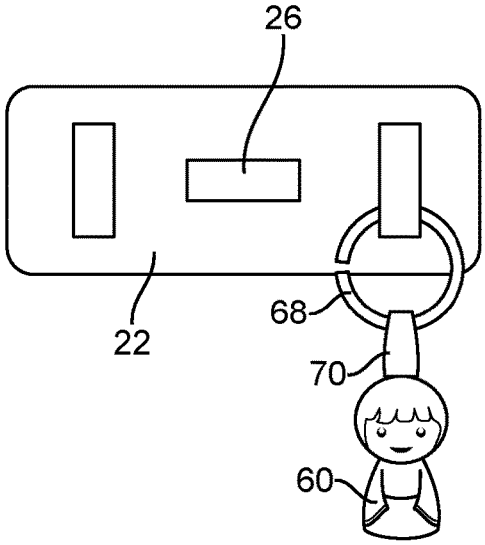
Figure 10D:
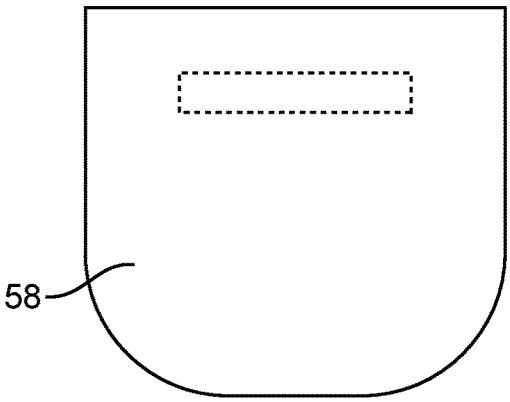
Figure 10E:
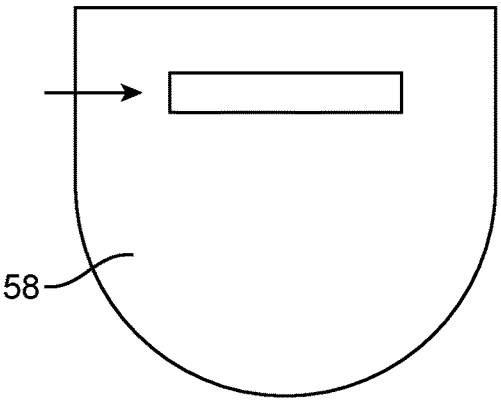
Figure 10F:
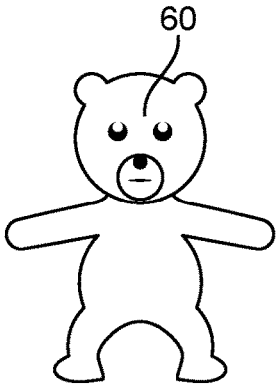
Figure 10G:
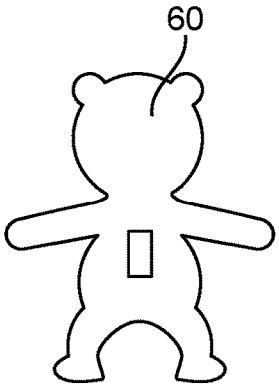
Figure 10H:
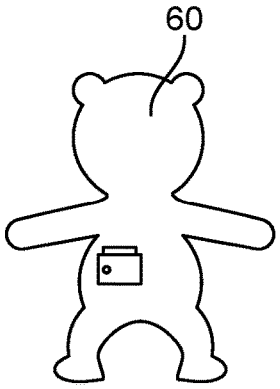
Figure 10I:
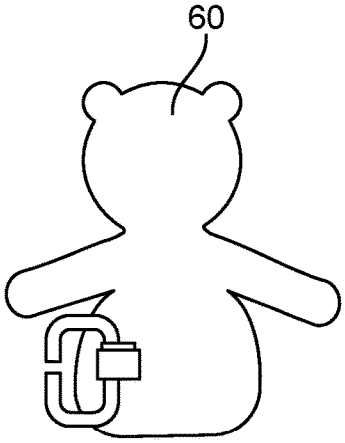
Figure 10J:
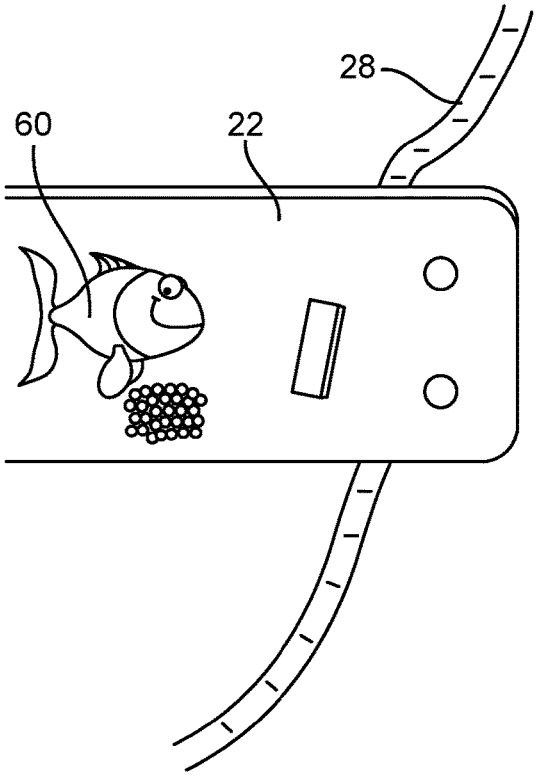

FIG. 10C shows another variation of fastener 22 and toy 60 having a ring attachment to attach the toy 60 to loop 26. This attachment means may allow a user to easily attach and detach toy 60 from the fastener 22. A C-ring, loop, or other attachment means may be used to attach toy 60. FIGS. 10D and 10E show pockets 58. Pockets 58 may have a snap fastener or a loop attached within. The pockets 58 may be configured as another means for holding a toy 60 within. FIGS. 10F to 10I show a toy 60 that may be attached within the pocket 58 in various configurations. For example, the toy 60 may have a snap, loop, or C-ring attached to its back for the purpose of being held in pocket 58. FIG. 10J shows yet another variation of the fastener 22 with tubing 28 passed therethrough. Tubing 28 may be passed through the fastener 22 without disturbing the infant playing with toy 60. Fastener 22 may be attached and detach to garment 10 or any other garment as desired.

While illustrative examples are described above, it will be apparent to one skilled in the art that various changes and modifications may be made therein. Moreover, various apparatus or procedures described above are also intended to be utilized in combination with one another, as practicable. The appended claims are intended to cover all such changes and modifications that fall within the true spirit and scope of the invention.

What is claimed is:

1. A garment for assisting a user holding an infant, the garment comprising:

a first front portion having an open configuration and having a closed configuration in which the first front portion is configured to overlap the user;

a second front portion having an open configuration and having a closed configuration in which the second front portion overlaps and attaches to the first front portion when the first front portion is in the closed configuration and the garment is worn by the user while holding the infant;

the first front portion defining a vertically elongated opening which is positioned to provide access through the opening and to the infant from outside of the garment, the vertically elongated opening being at least partially covered by the second front portion when the second front portion is in the closed position;

a first sleeve extending directly from the first front portion;

a second sleeve extending directly from the second front portion; and at least one fastener attached to the garment at the first front portion and the first sleeve and positioned relative to the opening to secure at least part of a tubing or wire extending from the infant.

2. The garment of claim 1, wherein the at least one fastener comprises a hook-and-loop fastener, a tie, or a snap.

3. The garment of claim 1, wherein the garment comprises a plurality of additional fasteners.

4. The garment of claim 3, wherein the plurality of additional fasteners each comprises a plurality of loops each configured to hold at least part of the medical tubing extending from the infant, wherein the plurality of loops of one of the plurality of fasteners extend at different angles with respect to the plurality of loops of another of the plurality of additional fasteners.

5. The garment of claim 3, wherein the plurality of additional fasteners are selected from the group consisting of hook-and-loop fasteners, ties, and snaps.

6. The garment of claim 1, wherein the at least one fastener comprises a plurality of loops each configured to hold at least part of the tubing extending from the infant.

7. The garment of claim 6, wherein the plurality of loops are each placed at different angles with respect to the at least one fastener.

8. The garment of claim 1, wherein the at least one fastener is configured to be detached from the garment, and wherein the at least one fastener is configured to be repositioned on the garment.

9. The garment of claim 1, further comprising a second elongated opening on the second front portion, the second elongated opening positioned to provide access through the second elongated opening and to the infant from outside of the garment.

10. The garment of claim 1, wherein the garment further comprises sensing fabrics configured to monitor physiological characteristics of the user and the infant.

11. The garment of claim 1, wherein the at least one fastener has an L-shape.

12. The garment of claim 1, wherein the at least one fastener has a T-shape.

13. The garment of claim 1, wherein the at least one fastener has a substantially straight shape.

14. The garment of claim 1, further comprising at least one second fastener located on the second sleeve.

15. The garment of claim 1, wherein the vertically elongated opening comprises a plurality of tabs to open or close portions of the vertically elongated opening.

16. An assembly for assisting a user holding an infant, the assembly comprising:

a first front portion having an open configuration and having a closed configuration in which the first front portion is configured to overlap the user;

a second front portion having an open configuration and having a closed configuration in which the second front portion overlaps and attaches to the first front portion when the first portion is in the closed configuration and the garment is worn by the user while holding the infant;

the first front portion defining a vertically elongated opening which is positioned to provide access through the opening and to the infant from outside of the garment, the vertically elongated opening being at least partially covered by the second front portion when the second front portion is in the closed position;

a first sleeve extending directly from the first front portion;

a second sleeve extending directly from the second front portion; and at least one fastener attached to the garment at the first front portion and the first sleeve and positioned relative to the opening to secure at least part of a tubing or wire extending from the infant; and a cover configured to be secured to at least a portion of a support for supporting the user, the cover having a back portion, a front portion, and a side portion, and at least one cover fastener attached to the cover, the at least one cover fastener positioned relative to the opening to secure at least part of the tubing or wire extending from the infant.

17. The garment of claim 1, wherein the at least one fastener has at least one toy attached, wherein the at least one toy is configured to be reached by the infant.

18. The garment of claim 1, wherein the at least one fastener has at least one tab attached, wherein the at least one tab is configured to be reached by the infant.

19. A method of assisting a user holding an infant, the method comprising the steps of:

placing a garment around the user and the infant, the garment having a first front portion with an open configuration and a closed configuration, a second front portion having an open configuration and a closed configuration in which the second front portion overlaps and attaches to the first front portion when the first front portion is in the closed configuration, a first sleeve extending directly from the first portion, and a second sleeve extending directly from the second portion;

overlapping the first portion with the second portion when the garment is worn by the user while holding the infant, the first portion defining a vertically elongated opening which is positioned to provide access through the opening and to the infant from outside of the garment, the vertically elongated opening being at least partially covered by the second front portion when the second front portion is in the closed position; and securing at least part of a tubing or wire extending from the infant with at least one fastener positioned at the first front portion and the first sleeve relative to the opening.

20. The method of claim 19, wherein at least one fastener comprises a hook-and-loop fastener, a tie, or a snap.

21. The method of claim 19, wherein the garment comprises a plurality of additional fasteners.

22. The method of claim 19, wherein the at least one fastener comprises a plurality of loops each configured to hold at least part of the tubing extending from the infant.

23. The method of claim 22, wherein the plurality of loops are each placed at different angles with respect to the at least one fastener.

24. The method of claim 19, further comprising detaching the at least one fastener from the garment, wherein the at least one fastener is configured to be repositioned on the garment.

25. A garment for assisting a user holding an infant, the garment comprising:

a first front portion, a second front portion, a back portion, a first sleeve extending directly from the first portion, a second sleeve extending directly from the second portion wherein the first portion defines a vertically elongated opening positioned to provide access through the opening and to the infant from outside of the garment, the vertically elongated opening being at least partially covered by the second front portion when the second front portion is in the closed position, wherein the opening is at least partially closed with at least one fastener;

a first fastener attached to the garment at the first front portion and the first sleeve, wherein the first fastener has an L-shape, wherein the first fastener comprises a hook-and-loop fastener, a tie, or a snap, wherein the first fastener comprises a plurality of loops each configured to hold at least part of the medical tubing extending from the infant;

a second fastener attached to the garment at the second front portion, wherein the second fastener has an L-shape, wherein the second fastener comprises a hook-and-loop fastener, a tie, or a snap, wherein the second fastener comprises a plurality of loops each configured to hold at least part of the medical tubing extending from the infant;

a third fastener attached to the garment at the first front portion and the back portion, wherein the third fastener has a T-shape, wherein the third fastener comprises a hook-and-loop fastener, a tie, or a snap, wherein the third fastener comprises a plurality of loops each configured to hold at least part of the medical tubing extending from the infant; and a fourth fastener attached to the garment at the second front portion and the back portion, wherein the fourth fastener has a T-shape, wherein the fourth fastener comprises a hook-and-loop fastener, a tie, or a snap, wherein the fourth fastener comprises a plurality of loops each configured to hold at least part of the medical tubing extending from the infant.

* * * * *